US011834615B2

(12) United States Patent
Koseoglu

(10) Patent No.: US 11,834,615 B2
(45) Date of Patent: Dec. 5, 2023

(54) STAGED CATALYTIC REFORMING PROCESS

(71) Applicant: SAUDI ARABIAN OIL COMPANY, Dhahran (SA)

(72) Inventor: Omer Refa Koseoglu, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/702,128

(22) Filed: Dec. 3, 2019

(65) Prior Publication Data

US 2021/0163829 A1 Jun. 3, 2021

(51) Int. Cl.

| | |
|---|---|
| ***C10G 35/02*** | (2006.01) |
| ***C10G 35/24*** | (2006.01) |
| ***C10G 63/02*** | (2006.01) |

(52) U.S. Cl.

CPC ..... *C10G 35/02* (2013.01); *C10G 35/24* (2013.01); *C10G 63/02* (2013.01); *C10G 2300/4006* (2013.01); *C10G 2300/4012* (2013.01)

(58) Field of Classification Search

CPC ..... C10G 63/02

See application file for complete search history.

(56) References Cited

U.S. PATENT DOCUMENTS

| | | | | |
|---|---|---|---|---|
| 2,380,853 | A * | 7/1945 | Linn | C07C 15/06 585/413 |
| 2,867,576 | A * | 1/1959 | Honeycutt | C10G 59/06 208/65 |
| 3,372,108 | A | 3/1968 | Epperly | |
| 3,669,875 | A * | 6/1972 | Plank | C10G 59/02 208/65 |
| 3,684,692 | A | 8/1972 | Keith et al. | |
| 3,705,095 | A | 12/1972 | Dalson et al. | |
| 3,883,418 | A | 5/1975 | Drehman et al. | |
| 4,551,228 | A * | 11/1985 | Ramella | C10G 35/085 208/65 |
| 5,672,265 | A | 9/1997 | Schmidt et al. | |
| 5,922,923 | A | 7/1999 | Park et al. | |

(Continued)

FOREIGN PATENT DOCUMENTS

| | | | |
|---|---|---|---|
| FR | 3014894 | A1 | 6/2015 |
| KR | 100601258 | B1 | 7/2006 |

OTHER PUBLICATIONS

International Search Report issued for PCT/US2020/014978, dated Jul. 15, 2020 (5 pages).

(Continued)

*Primary Examiner* — In Suk C Bullock
*Assistant Examiner* — Alyssa L Cepluch
(74) *Attorney, Agent, or Firm* — Osha Bergman Watanabe & Burton LLP

(57) ABSTRACT

A process and a system for reforming and upgrading a heavy naphtha feedstock may include dehydrogenating naphthenes in the heavy naphtha feedstock to form a first effluent stream comprising aromatics and then separating the aromatics via extraction from the produced first effluent stream to produce a second effluent stream containing raffinate paraffins. The process may then include subjecting the second effluent stream to cyclization reactions to produce a third effluent stream comprising aromatics and then combining the first effluent stream and the third effluent stream prior to extraction.

8 Claims, 2 Drawing Sheets

(56) References Cited

U.S. PATENT DOCUMENTS

| | | | | |
|---|---|---|---|---|
| 8,608,941 | B2 | 12/2013 | Haizmann et al. | |
| 2008/0083651 | A1 | 4/2008 | Abhari et al. | |
| 2012/0273392 | A1* | 11/2012 | Serban | C10G 69/08 208/63 |
| 2013/0087482 | A1 | 4/2013 | Haizmann et al. | |
| 2013/0144097 | A1* | 6/2013 | Bender | C07C 4/06 585/254 |
| 2013/0158317 | A1 | 6/2013 | Moser et al. | |
| 2013/0158320 | A1 | 6/2013 | Moser et al. | |
| 2014/0374312 | A1 | 12/2014 | Wegerer et al. | |
| 2018/0155642 | A1* | 6/2018 | Al-Ghamdi | C10G 69/08 |

OTHER PUBLICATIONS

Written Opinion issued for PCT/US2020/014978, dated Jul. 15, 2020 (8 pages).

Examination Report issued in corresponding GCC Application No. GC 2020-39367, dated Jun. 17, 2021 (4 pages).

Prestvik, Rune, et al., "Compositional Analysis of Naphtha and Reformate", Catalytic Naphtha Reforming, 2nd Edtion, Marcel Dekker, Inc., 2004, pp. 1-33 (36 pages).

Parera, Jose M. and Nora S. Figoli, "Chemistry of Bifunctional Metal—Acid Catalysis", Catalytic Naphtha Reforming, 2nd Edition, Marcel Dekker, Inc., 2004, pp. 75-104 (33 pages).

* cited by examiner

STAGED CATALYTIC REFORMING PROCESS

BACKGROUND

Catalytic reforming is a major conversion process in petroleum refinery and petrochemical industries. Reforming is a catalytic process which converts low octane naphthas that have been distilled from crude oil into higher octane reformates used in gasoline blending and aromatic-rich reformates used for aromatic production. While thermal reforming could produce reformate with octane numbers of 65 to 80 (depending on the yield), catalytic reforming increases the octane numbers to around 90 to 95. Basically, the process rearranges or restructures the hydrocarbon molecules in naphtha feedstocks and breaks some of the molecules into smaller molecules. Specifically, low octane naphtha may be transformed into high-octane motor gasoline blending stock and aromatics rich in benzene, toluene, and xylenes, with hydrogen and liquefied petroleum gas as a byproduct.

There are four major types of reactions that take place during reforming processes: dehydrogenation of naphthenes to aromatics, dehydrocyclization of paraffins to aromatics, isomerization, and hydrocracking. In the catalytic reforming process, paraffins and naphthenes are restructured to produce isomerized paraffins and aromatics of relatively higher octane numbers. The catalytic reforming converts low octane n-paraffins to i-paraffins and naphthenes. Naphthenes are converted to higher octane aromatics. The aromatics are left essentially unchanged or some may be hydrogenated to form naphthenes due to reverse reactions taking place in the presence of hydrogen. A particular hydrocarbon/naphtha feed molecule may undergo more than one category of reaction and/or may form more than one product.

Due to dehydrogenation reactions being very endothermic, the hydrocarbon stream has to be heated between each catalyst bed. Further, dehydrogenation is the main chemical reaction that occurs in catalytic reforming, producing substantial quantities of hydrogen gas. In addition to the hydrogen gas produced in dehydrogenation, dehydrocylization also releases hydrogen. The hydrogen produced in these reaction can be used in hydrotreating or hydrocracking processes. However, an excess of hydrogen is produced, and thus catalytic reforming processes are unique in that they are the only petroleum refinery processes to produce hydrogen as a by-product. Catalytic reforming generally operates with multiple reactors (commonly three), each with a bed of catalyst. Reactors can be broadly classified as moving-bed, fluid-bed, or fixed-bed type. In semi-regenerative units, regeneration of all reactors can be carried out simultaneously in situ after three to twenty-four months of operation by first shutting down the whole process. On the other hand, in continuous reforming processes, catalysts can be regenerated in one reactor at a time, once or twice per day, without disrupting the operation of the unit.

Prior Art Catalytic Reforming

Catalytic reforming processes are conventionally conducted in one step where a feedstock is fed to a single or multiple reactors in which all reactions take place to produce an effluent product stream. In particular, catalytic reforming is conventionally carried out by feeding a naphtha (after pretreating with hydrogen if necessary to remove sulfur, nitrogen and metallic contaminants, for example) and hydrogen mixture to a furnace, where it is heated to the desired temperature of 450° to 560° C. It is then passed through catalytic reactors at hydrogen pressures of 1 to 50 bars and an LHSC in the range of 0.5 $h^{-1}$ to 40 $h^{-1}$.

Referring to FIG. 1, a prior art process flow of a catalytic reforming system is illustrated. Catalytic reforming systems and processes typically include a series of reactors 10, 20, 30 and 40 which operate at temperatures of about 450° to 560° C. A feedstock 102 is introduced into a heat exchanger 45 and then to furnace 15A to increase its temperature. The heated feedstock 102 is then treated in the reforming reactors to produce an effluent stream 104 that may be further treated at separator 50 to separate a hot product hydrogen 105 and separator bottom stream 106. The heated feedstock 102 may optionally be sent directly to and treated in any of reactors 20, 30, and 40 via 103A, 103B, and 103C, respectively. Separator bottom stream 106 is fed to stabilizer 60, in which reformate 108 may be separated from any excess hydrogen or light effluent product gases 110. The reformate product may then be sent to the gasoline pool or to an aromatic recovery complex to recover BTX.

As mentioned above, the reforming reactions are endothermic, resulting in the cooling of reactants and products, and requiring heating of effluent, typically by direct-fired furnaces 15B, 15C and 15D, prior to charging as feed to a subsequent reforming reactor. As a result of the very high reaction temperatures, catalyst particles are deactivated by the formation of coke on the catalyst which reduces the available surface area and active sites for contacting the reactants.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a reforming process for upgrading a heavy naphtha feedstock that includes dehydrogenating naphthenes in the heavy naphtha feedstock to form a first effluent stream comprising aromatics. The process further includes separating the aromatics via extraction from the produced first effluent stream to produce a second effluent stream containing raffinate paraffins. The second stream may then be subjected to cyclization reactions to produce a third effluent stream comprising aromatics. The process further includes combining the first effluent stream and the third effluent stream prior to extraction.

In a further aspect, embodiments disclosed herein relate to a system for producing and separating aromatics from a heavy naphtha feedstock. The feedstock may include at least paraffins and naphthenes, and the system may include one or more dehydrogenation reactors for converting naphthenes in the heavy naphtha feedstocks into aromatics in a first effluent. The system may further include an aromatic extracting unit for extracting at least a portion of the aromatics from the first effluent to form a second effluent stream of raffinate comprising at least the paraffins; and one or more cyclization reactors for converting the paraffins in the second effluent stream into aromatics in a third effluent stream.

Other aspects and advantages of the claimed subject matter will be apparent from the following description and the appended claims.

DETAILED DESCRIPTION

Figure 1:
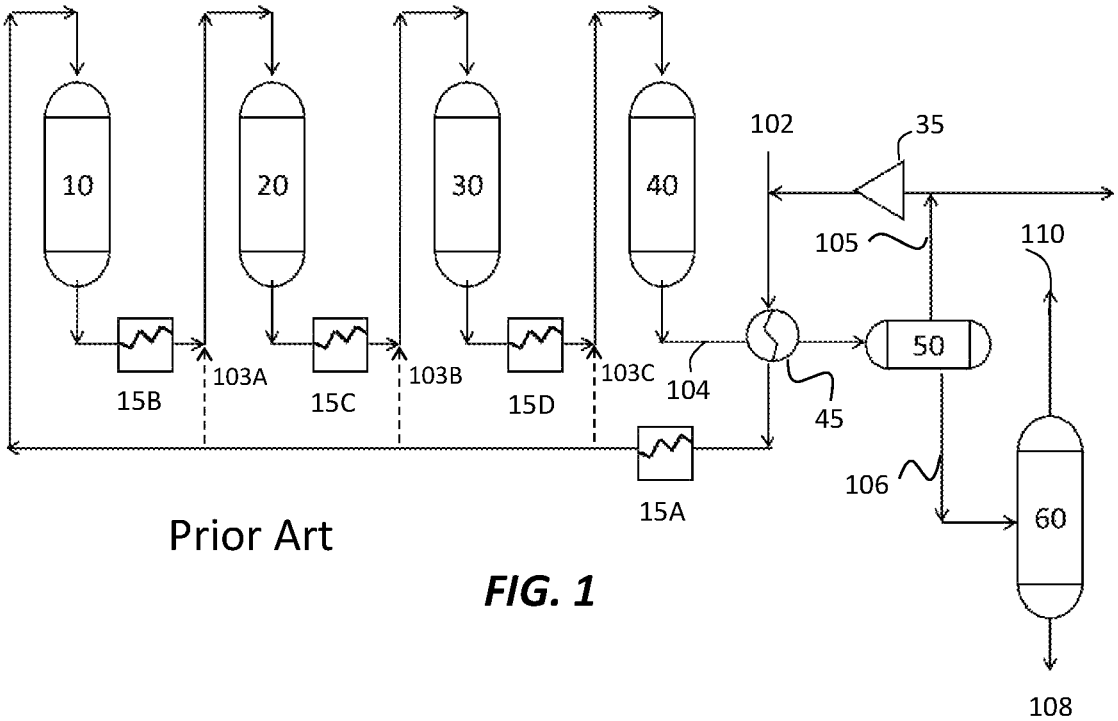
FIG. 1 is a schematic illustration depicting a conventional catalytic single step process configuration.

Embodiments in accordance with the present disclosure generally relate to methods and apparatuses for a three step catalytic reforming process that upgrades a naphtha feedstock. In one or more embodiments of the present disclosure, the three general steps may include a first step of dehydrogenating naphthenes to aromatics at low temperatures; a second step of separating aromatics from the effluents; and a third step in which the unreacted paraffins and naphthenes exiting the aromatic extraction from the second step are directed to cyclization reactors to undergo cyclization.

The present systems and methods described herein are designed to utilize multiple reactors, controlled at different conditions to maximize paraffin/naphthene cyclization and aromatization, while also enhancing the endothermic reactions of the reforming process.

For the purposes of the present disclosure, the numerous valves, temperature sensors, electronic controllers and the like that are customarily employed and well known to those of ordinary skill in the art of refinery operations are not described. Further, accompanying components that are in conventional refinery operations for catalytic reforming processes that are known to one of ordinary skill in the art may not be shown or discussed herein.

Naphthas produced from crude oil distillation generally contain paraffins, napthenes, and aromatics. The naphtha feedstocks used in catalytic reforming processes may be "heavy" naphtha (containing more than six carbon atoms), which may also be referred to as "straight-run" naphthas. Such naphthas may generally have an initial boiling point of 60 to 150° C. and a final boiling point of 190 to 205° C. In one or more embodiments of the present disclosure, the feedstock may be heavy naphtha comprising feedstock comprising naphthenes. However, it is also envisioned that low-octane naphtha (e.g., coker naphtha) or hydrocracker naphtha that contains substantial quantities of naphthenes, or naphthas having lower boiling points could also be feeds in one or more embodiments.

In accordance with one or more embodiments of the present disclosure, during the catalytic reforming process, paraffins and naphthenes are restructured to produce isomerized paraffins and aromatics of relatively higher octane numbers. In particular, the catalytic reforming may convert low octane n-paraffins to i-paraffins and naphthenes, and naphthenes may be converted to higher octane aromatics. In accordance with embodiments of the present disclosure, aromatics may be extracted during the reforming, specifically between dehydrogenation and cyclization, to increase yield and reduce reverse reactions (e.g., hydrogenating to form naphthenes) that may otherwise take place in the presence of hydrogen. In particular, in a first step, naphthenes may be converted to aromatics by dehydrogenation at low temperatures compared to the reaction temperatures of subsequent cyclization reactor(s). After dehydrogenation, the aromatics may then be extracted from the first dehydrogenation reactor effluents in a second step to produce aromatic product and a raffinate comprising a second effluent, which may be mainly comprised of paraffins and unreacted naphthenes. The second effluent may then be directed to cyclization reactor(s) to undergo cyclization reactions to reform the paraffins comprised in the reformate in a final step to produce a third effluent.

The hydrocarbon/naphtha feed composition, the impurities present therein, and the desired products may play a role in determining the precise process parameters and the specific choice of catalyst(s), process type, and the like. A variety of chemical reactions may be targeted by specific selection of a catalyst or by altering the operating conditions to influence both the yield and selectivity of conversion of paraffinic and naphthenic hydrocarbon precursors to particular aromatic hydrocarbon structures.

Figure 2:
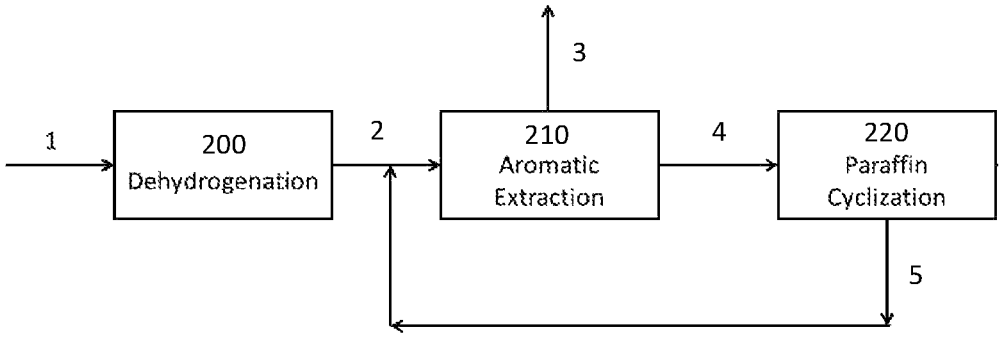
FIG. 2 is a schematic illustration depicting a three step process in accordance with one or more embodiments of the present disclosure

FIG. 2 depicts an overview of a three step catalytic reforming process and system in accordance with one or more embodiments of the present disclosure. Generally, embodiments may include dehydrogenation 200 of a naphtha feedstock 1 (such as a straight-run naphtha, as described above) to provide a first effluent stream 2. Dehydrogenation of the naphtha feedstock 1 may include dehydrogenation of the naphthenes present in the naphtha feedstock 1 to produce aromatics. Thus, the first effluent stream 2 containing such aromatics may be subjected to aromatic extraction 210 to separate aromatics 3 out of the reformer and from a second effluent stream 4. The second effluent stream 4 may comprise unreacted paraffins and naphthenes and is directed to cyclization reactors 220 (preferably dehydrocyclization reactors, converting paraffins into aromatics, for example) to produce a third effluent stream 5. Third effluent stream 5 may optionally be recycled back through the system, and be combined with the first effluent stream 2, to increase yield of higher end products.

Figure 3:
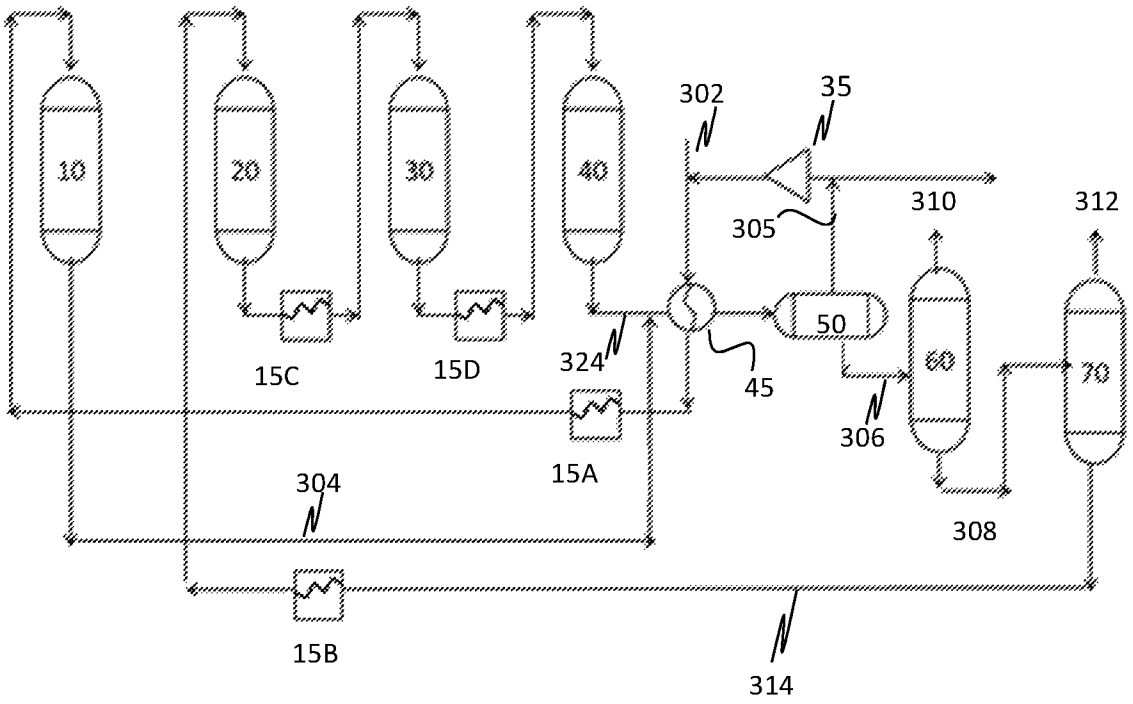
FIG. 3 depicts a detailed schematic of a three staged reforming process configuration in accordance with one or more embodiments of the present disclosure.

Referring now to FIG. 3, a detailed schematic showing a three-step catalytic reforming process of the present disclosure, in which an aromatic extraction is integrated between an initial dehydrogenation and subsequent cyclization, is shown.

As illustrated, a heavy naphtha stream 302 is heated in a heat exchanger 45 and is then subjected to a further heat treatment in furnace 15A before being directed to catalytic dehydrogenation reactor 10 (which optionally may include more than one reactor). In catalytic dehydrogenation reactor 10, naphthenes contained in the heavy naphtha stream 302 may be converted to aromatics, at temperatures ranging, for example, from 400-450° C. The dehydrogenation reactor effluents, or first effluent stream 304, are cooled in heat exchanger 45. Thus, heat exchanger 45 is a feed/effluent exchanger in which the feed to the dehydrogenation reactor 10 is heated by the effluent from the dehydrogenation reactor 10. After cooling, the first effluent stream 304 is directed to separator 50, which separates the gas-liquid phases from each other.

Specifically, the first effluent stream 304 is separated in separator 50 for recovery of hydrogen stream 305 and a separator bottoms stream 306. Recovered hydrogen stream 305 may be split, and a portion of the hydrogen 305 may be fed to compressor 35 and recycled back to the heavy naphtha feedstock 302. However, as dehydrogenation produces substantial quantities of hydrogen gas, the remaining portion of the recycled hydrogen gas 305 may be sent to other refining unit operations, such as hydro-treating and hydrocracking. The separator bottoms stream 306 is sent to a stabilizer column 60 to separate and remove any excess hydrogen 310 from a liquid reformate stream 308.

The reformate 308 is sent to an aromatic extraction unit 70 to obtain aromatics 312 as an extract and a second effluent stream 314 comprising paraffins and unreacted naphthenes as raffinate. The aromatics may be subsequently sent to an aromatic recovery complex to recover, for example, benzene, toluene, and xylene (collectively referred to as BTX). The raffinate from the aromatic extraction, i.e., second effluent stream 314 is sent to cyclization reactors, 20, 30, 40. Based on the initial dehydrogenation and aromatic extraction, at least a majority of the raffinate may be paraffins. In particular embodiments, at least 95 wt % of the raffinate is constituted by paraffins. Specifically, the initial dehydrogenation may convert at least a substantial portion of the naphthenes present in the heavy naphtha feed into aromatics. Following aromatic extraction, the remaining raffinate has unreacted naphthenes and residual aromatics; however, such components may comprise less than 5 wt % of the raffinate. In one or more embodiments, the second effluent stream containing raffinate paraffins may comprise paraffins in amount ranging from 95 to 99 wt % and residual aromatics and unreacted naphthenes in amount ranging from 1 to 5 wt %.

Further, as shown, second effluent stream 314 may be heated by furnace 15B prior to feeding into reactor 20 (and heated by furnaces 15C, 15D, as the stream feeds into reactors 30, 40, respectively). While three cyclization reactors 20, 30, 40 are shown, it is understood that any number of reactors may be present. Further, it is also understood that in addition to cyclization reactions, such reactors 20, 30, 40 may also perform dehydrogenation (in combination with cyclization i.e., dehydrocyclization, as well as a sequential reaction) and/or isomerization to convert paraffins and unreacted naphthenes into isomers (i.e., n-paraffins to isoparaffins) and/or into aromatics. However, as mentioned above, based on the initial dehydrogenation and then aromatic extraction, the second effluent stream may be primarily paraffinic, as compared to the original naphtha feedstock. Whereas dehydrogenation reactor 10 is operated at temperatures ranging from 400-450° C., as described above, the cyclization reactors 20, 30, 40 may operate at a higher temperature than the dehydrogenation reactor 10, such as at a temperature ranging from 480-520° C. Furnaces 15C and 15D may be used between cyclization reactors 20, 30, 40 to maintain the temperature of the stream. The number and conditions of cyclization reactors may depend on the feedstock composition, the extent of reactions, and the targeted product properties. Further, it is also understood that reactors 20, 30, 40, may be operated in semi-regenerative configurations, cyclic configurations or continuous catalyst regeneration configurations.

In one or more embodiments, a third effluent stream 324 is produced from the cyclization reactors 20, 30, 40 and may then be combined with the first effluent stream 304 coming from the dehydrogenation reactor 10. Thus, the combined stream may then be subjected the same separation scheme described above, including cool down in exchanger 45, phase separation in separator 50, stabilization in stabilizer 60, and aromatic extraction in extraction unit 70.

In addition to the operational temperatures mentioned above, the processing conditions of the different reformers allows for different operational control. Additional variables that may be controlled to alter the quality of the reformed product include the space velocities, the hydrogen to hydrocarbon feed ratios, and the pressures.

As mentioned above, the naphtha stream 302 is reformed in dehydrogenation reactor 10 to produce a first product effluent stream 304. In one or more embodiments, the operating conditions for the dehydrogenation reactor 10 include a temperature in the range of from 350° C. to 460° C., and in particular embodiments a temperature ranging from about 400° C. to 450° C.; a pressure in the range of from 1 bar to 50 bars, and in certain embodiments from 1 bar to 20 bars; and a LHSV in the range of 0.1 $h^{-1}$ to 40 $h^{-1}$, and in certain embodiments from 0.5 $h^{-1}$ to 2 $h^{-1}$. In one or more embodiments, operating conditions for the dehydrogenation reactor may also include a hydrogen to hydrocarbon ratio ranging from 4 to 8.

In accordance with one or more embodiments of the present disclosure, the second effluent stream 314 comprises a fractioned raffinate separated from the aromatic extraction unit 70 that may be cyclized and aromatized via dehydrocyclization reactions in one or more of the cyclization reactors 20, 30, 40, to produce third effluent stream 324. In one or more embodiments, the operating conditions for the cyclization reactors 20, 30, 40 include a temperature in the range of from 450° C. to 550° C., and in particular embodiments a temperature ranging from about 480° C. to 520° C.; a pressure in the range of from 1 bar to 50 bars, and in certain embodiments from 1 bar to 20 bars; and an LHSV in the range of 0.1 $h^{-1}$ to 40 $h^{-1}$, and in certain embodiments from 0.5 $h^{-1}$ to 2 $h^{-1}$. In one or more embodiments, operating conditions for the dehydrogenation reactor may also include a hydrogen to hydrocarbon ratio ranging from 4 to 8. In one or more embodiments, two or more, or three or more cyclization reactors may be used, in series.

In one or more embodiments of the present disclosure, the dehydrogenation catalyst and the cyclization reformation catalyst used may be any suitable catalyst that is known to one of ordinary skill in the art. Such catalysts include mono-functional or bi-functional reforming catalysts which generally contain one or more active metal component of metals or metal compounds (such as oxides or sulfides) selected from the Groups 8-10 of the IUPAC Periodic Table. A bi-functional catalyst has both metal sites and acidic sites. In certain embodiments, the active metal component can include one or more noble metals, such as platinum, rhenium, gold, palladium, germanium, nickel, silver, tin, or iridium, or halides. The active metal component may be deposited or otherwise incorporated on a support, such as amorphous alumina, amorphous silica alumina, zeolites, or combinations thereof. In certain embodiments, platinum or platinum alloy supported on alumina or silica or silica-alumina are the reforming catalyst. Effective liquid hourly space velocity values ($h^{-1}$), on a fresh feed basis relative to the hydrotreating catalysts, are in the range of from about may have a lower limit of any of 0.5, 1, or 1.5 $h^{-1}$, and an upper limit of any of 2, 3, or 4 $h^{-1}$, where any lower limit can be used in combination with any upper limit. In particular embodiments, the catalysts used in the naphthene dehydrogenation step may be a conventional reforming catalyst or noble metals (or Group VIIIB) on alumina, and they may be acidic or non-acidic. The catalysts in the cyclization steps may be conventional catalytic reforming catalysts and may include alumina based or zeolitic based catalysts containing noble metals.

EXAMPLES

The following examples are merely illustrative and should not be interpreted as limiting the scope of the present disclosure. An example was provided to illustrate the impact of the three stage catalytic reforming process described in one or more embodiments of the disclosure. The resulting properties of a dehydrogenated feedstock are given in Table 1, and the properties of the resulting dehydrogenated and dehydrocyclized reformate are provided in Table 2.

A heavy naphtha stream was processed over a conventional catalytic reforming catalysts at 460° C., 8 bars, hydrogen to hydrocarbon molar ratio of 7 and LHSV of 1 $h^{-1}$. Table 1 summarizes feedstock composition along with yield and composition of the dehydrogenated product. As shown, 83.7 wt % of naphthenes were converted to aromatics.

TABLE 1

| Variables | | Heavy Naphtha Feedstock | Dehydrogenated Product |
|---|---|---|---|
| Time-on-stream | h | | 7.0 |
| RON | | | 86.43 |
| n-Paraffins | W % | 34.67 | 10.66 |
| iso-Paraffins | W % | 28.15 | 23.73 |
| Olefins | W % | 2.55 | 0.00 |
| Naphthenes | W % | 19.20 | 3.12 |
| Aromatics | W % | 13.07 | 62.49 |
| Unknown | W % | 2.34 | 0.00 |
| | | | 100.00 |
| Molecular Weight | g/mol | | 104.79 |
| Specific Gravity | g/mL | | 0.7902 |
| C1 + C2 Yield | W % | 0.00 | 1.41 |
| C3 + C4 Yield | W % | 0.00 | 5.55 |
| C5 + Yield | W % | 100.00 | 89.09 |
| Hydrogen Yield | W % | 0.00 | 3.31 |
| Total | | | 99.36 |

Example 2: Paraffin Cyclization

The heavy naphtha stream in example 1 was processed and subjected to cyclization reactions over a conventional catalytic reforming catalysts at 520° C., 8 bars, and a hydrogen to hydrocarbon molar ratio of 7 with an LHSV of 1 $h^{-1}$. Table 2 summarizes yield and composition of the dehydrogenated and cyclized product. As estimated, 84.6 wt % of paraffins were converted to aromatics.

TABLE 2

| Variables | | Dehydrogenated and Dehydrocyclized reformate |
|---|---|---|
| Time-on-stream | h | 36.0 |
| RON | | 106.49 |
| Compound Type | | |
| n-Paraffins | W % | 2.71 |
| iso-Paraffins | W % | 6.93 |
| Olefins | W % | 0.00 |
| Naphthenes | W % | 0.49 |
| Aromatics | W % | 89.87 |
| Unknown | W % | |
| Total | W % | 100.00 |
| Liquid Properties | | |
| Molecular Weight | g/mol | 105.32 |
| Specific Gravity | g/mL | 0.8450 |
| Yields | | |
| C1 + C2 Yield | W % | 2.3 |
| C3 + C4 Yield | W % | 5.4 |
| C5 + Yield | W % | 87.2 |
| Hydrogen Yield | W % | 5.1 |
| Total | W % | 100.0 |

Thus, as evidenced in the tables above, the naphthenes in the naphtha feedstock may be primarily dehydrogenated to form aromatics. By extracting such aromatics prior to the cyclization reactions, the reaction kinetics of such downstream reactions may be improved. Additionally, the three staged catalytic reforming process may provide for less required heating of the effluent streams and reduced the reactor/catalyst volume requirements.

Although the preceding description has been described herein with reference to particular means, materials and embodiments, it is not intended to be limited to the particulars disclosed herein; rather, it extends to all functionally equivalent structures, methods and uses, such as are within the scope of the appended claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A reforming process for upgrading a heavy naphtha feedstock, comprising:

feeding the heavy naphtha feedstock to a first stage consisting of dehydrogenating naphthenes in the heavy naphtha feedstock in one or more dehydrogenation reactors of a three-stage reforming system to form a first effluent stream comprising aromatics, wherein the dehydrogenation is conducted at a pressure ranging from 1 to 20 bars, at a temperature ranging from 400 to 450° C., and with a hydrogen to hydrocarbon molar ratio ranging from 6 to 8, and wherein the dehydrogenation is conducted at a liquid hourly space velocity ranging from 0.5 $h^{-1}$ to 2 $h^{-1}$;

flowing the first effluent stream to a second stage comprising separating extracted aromatics from raffinate paraffins via extraction of the extracted aromatics from the first effluent stream to produce a second effluent stream containing the raffinate paraffins, wherein separating the extracted aromatics from the raffinate paraffins comprises:

separating the first effluent stream into a reformate stream and a hydrogen gas stream, wherein the hydrogen gas stream is split and a portion of the hydrogen gas stream is recycled back to the heavy naphtha feedstock and the remaining portion is directed away from the reforming to a refining unit, and extracting the extracted aromatics from the reformate stream in an aromatic extraction unit of the three-stage reforming system, thereby providing the second effluent stream containing at least 95 wt % raffinate paraffins; and flowing the second effluent stream to a third stage comprising subjecting the second effluent stream to cyclization reactions in one or more cyclization reactors of the three-stage reforming system to produce a third effluent stream comprising aromatics, wherein the first effluent stream and the third effluent stream are combined prior to extraction, wherein the cyclization reactions are conducted at a LHSV ranging from 0.5 $h^{-1}$ to 2 $h^{-1}$, and wherein the cyclization reactions are at a temperature ranging from 480 to 520° C.

2. The process of claim 1, wherein the combined first and third effluent stream are directed to a separator and separated in a separating step wherein a bottom stream comprising the aromatics of the first and third effluent stream is separated from a hydrogen gas stream.

3. The process of claim 1, wherein the second effluent stream containing raffinate paraffins comprises paraffins in amount ranging from 95 to 99 wt % and residual aromatics and unreacted naphthenes in amount ranging from 1 to 5 wt %.

4. The process of claim 1, wherein the refining unit is selected from the group consisting of hydro-treating, hydro-cracking, and combinations thereof.

5. The process of claim 1, wherein separating the first effluent stream into a reformate stream and a hydrogen gas stream comprises passing the first effluent stream to a separating unit, thereby forming a bottom stream separated from the hydrogen gas stream.

6. The process of claim 5, further comprising stabilizing the bottom stream via passing the bottom stream to a stabilizer column to further separate and remove hydrogen from the reformate stream.

7. The process of claim 1, further comprising passing the extracted aromatics to an aromatic recovery complex.

8. The process of claim 7, further comprising recovering benzene, toluene, and xylene in the aromatic recovery complex.

* * * * *